US008075208B2

(12) United States Patent
Green

(10) Patent No.: US 8,075,208 B2
(45) Date of Patent: Dec. 13, 2011

(54) MOBILE WORKSTATION

(76) Inventor: Teena Green, Kaysville, UT (US)

( * ) Notice: Subject to any disclaimer, the term of this patent is extended or adjusted under 35 U.S.C. 154(b) by 871 days.

(21) Appl. No.: 12/058,382

(22) Filed: Mar. 28, 2008

(65) Prior Publication Data

US 2008/0240837 A1 Oct. 2, 2008

Related U.S. Application Data

(60) Provisional application No. 60/908,537, filed on Mar. 28, 2007.

(51) Int. Cl.
*B41J 29/13* (2006.01)
*B41J 3/26* (2006.01)

(52) U.S. Cl. ..... 400/94; 400/91; 400/685

(58) Field of Classification Search ..... 190/11; 400/91, 94, 685, 693
See application file for complete search history.

(56) References Cited

U.S. PATENT DOCUMENTS

| | | | | |
|---|---|---|---|---|
| 1,246,203 | A * | 11/1917 | Willman | 312/29 |
| 5,485,922 | A * | 1/1996 | Butcher | 206/576 |
| 5,590,022 | A | 12/1996 | Harvey | |
| 5,626,323 | A * | 5/1997 | Lechman et al. | 248/286.1 |
| 5,666,265 | A | 9/1997 | Lutz et al. | |
| 5,915,661 | A | 6/1999 | Silverman et al. | |
| 6,331,936 | B1 | 12/2001 | Hom et al. | |
| 6,385,897 | B1 * | 5/2002 | Klabunde | 43/54.1 |
| 6,454,064 | B1 * | 9/2002 | Cheng | 190/11 |
| 6,547,071 | B2 | 4/2003 | Barber | |
| 2002/0063072 | A1 | 5/2002 | Pham | |

FOREIGN PATENT DOCUMENTS

| | | | |
|---|---|---|---|
| DE | 4411156 | A1 * | 11/1994 |
| DE | 4408295 | A1 * | 9/1995 |
| FR | 2652243 | A3 * | 3/1991 |
| FR | 2759870 | A1 * | 8/1998 |
| WO | 2004/081773 | A1 | 9/2004 |

OTHER PUBLICATIONS

Tutto Luggage, URL: www.tutto.com/22_steno_carry9.html, [accessed on Aug. 4, 2008 using www.archive.org using the Jun. 21, 2008 dated site <URL: http://web.archive.org/web/20060621010325/http://www.tutto.com/22_steno_carry9_htoml>], 2 pages.

* cited by examiner

*Primary Examiner* — Daniel J Colilla
(74) *Attorney, Agent, or Firm* — Seed IP Law Group PLLC

(57) ABSTRACT

A case for use with a stenotype machine, portable computer, and cables, power supply equipment, memory devices, as well as paper, writing utensils, and the like to form a mobile workstation. The case includes a top, a bottom, and a circumscribing sidewall, the top removably or hingedly attached to the side wall to cover an interior that is divided into multiple compartments, including at least a first compartment to store the portable computer, a second compartment to store the stenotype machine, and a third compartment to store cables for data and power that are connected to the computer and stenotype machine, the sidewall having an access opening for the stenotype machine to deploy for use while remaining attached to the case, and the case further including a bottom wall to which a stand is removably attached.

7 Claims, 13 Drawing Sheets

MOBILE WORKSTATION

BACKGROUND OF THE INVENTION

1. Field of the Invention

The present disclosure is directed to protective encasements for equipment and, more particularly, to a portable case for multiple pieces of electronic equipment that converts to a workstation.

2. Description of the Related Art

Professionals who work away from home are faced with the prospect of carrying a substantial amount of equipment to various locations and then setting up the equipment. For example, court reporters, stenographers using computer-aided transcription, videographers, and other technical professionals rely heavily on computers in addition to their tools of the trade, such as the stenotype machine or video camera, respectively. In spite of the fact that computer technology is constantly evolving and improving, tower-style chassis and CRT-based display monitors of a typical computer workstation can weigh 100 pounds or more and require high-volume packing materials. As a result, the portability of such systems is limited. Moreover, those professionals who utilize additional equipment, such as the stenotype machine or video machine, must transport and assemble this equipment into an operating configuration, often times under time constraints that require quick and efficient deployment of the equipment immediate use.

As an example, a court reporter has the following needs in taking testimony at remote sites using a stenotype machine with computer-aided transcription: (a) pack the machine, computer, and related supplies; (b) transport the equipment to the job site; (c) assemble the equipment into a working configuration, which requires unpacking and connecting cables and power cords; (d) manage documents and memory devices while recording testimony, including the display of transcribed testimony for spontaneous read back; (e) disassemble and store the equipment for transport back to an office; (f) retrieve documentation and computer memory devices from the stored equipment for transcription; and (g) prepare the equipment for future use.

There have been some efforts to provide technical professionals with portable systems for field use, but all such attempts have had significant compromises on the design and implementation of the various stored systems. For example, Mascot Metropolitan, Inc., sells the Tutto line of luggage that includes a carrying case for stenotype machines. This is nothing more than a four-wheeled suitcase that holds a computer and stenotype machine along with supplies. The reporter must still remove everything from the case and assemble it in working condition before being able to use the equipment and vice versa.

In general, existing products have not been designed to meet the specific demands of the court reporting professional. In part, the compromise in performance of prior cases is attributable to the absence of certain enabling technology, which has become available only recently. Hence, a new case for traveling professionals who must transport, assemble, and disassemble multiple pieces of mechanical and electrical equipment is needed.

Moreover, prior designs do not accommodate the needs of modern equipment. Standard components, such as a laptop computer or computer-aided stenotype machine, cannot remain in the case during use for reasons of access, stability, interconnection of cables and power cords. In addition, power supplies, high performance processors, and other components usually generate substantial heat and require adequate ventilation. In addition, the system must be impact resistant and dust tolerant. As with all computer products, it should be easy to service, flexible for popular options, quiet, and ergonomically designed for the user.

Thus, there exists a need for a truly portable, high performance, mobile workstation that facilitates easy portability, set-up and disassembly, and use of the equipment while remaining attached to the case, withstanding the elements and physical abuse, and maintaining an attractive appearance.

BRIEF SUMMARY OF THE INVENTION

The present disclosure is directed to a mobile workstation and to a case for use with portable equipment. In one embodiment the case is designed for use with a stenotype machine (preferably paperless), portable computer, and cables, power supply equipment, memory devices, as well as paper, writing utensils, and the like. The case includes a top, a bottom, and a circumscribing sidewall, the top removably attached to the side wall to cover an interior that is divided into multiple compartments, including at least a first compartment to store the portable computer, a second compartment to store the stenotype machine, a third compartment to store cables for data and power that are connected to the computer and stenotype machine, the sidewall having an access for the stenotype machine to deploy for use while remaining attached to the case, and the case further including a bottom wall.

In accordance with another aspect of the disclosure, the case includes a storage area for a stand and a connection device on the bottom wall to attach the stand for support of the case in a deployed configuration.

In accordance with another embodiment of the present disclosure, a mobile workstation is provided that includes a stenotype machine, portable computer, and cables, power supply equipment, memory devices, as well as paper, writing utensils, and the like, the workstation including a case having a top, a bottom, and a circumscribing sidewall, the top removably attached to the side wall to cover an interior that is divided into multiple compartments, including at least a first compartment to store the portable computer, a second compartment to store the stenotype machine, and a third compartment to store cables for data and power that are connected to the computer and stenotype machine, the sidewall having an access for the stenotype machine to deploy for use while remaining attached to the case, and the case further including a bottom wall; a handle coupled to the case and adapted to extend from and retract into the case; and at least two wheels rotatably mounted on the case.

In accordance with another aspect of the foregoing embodiment, the workstation includes a storage area for a stand and a connection device on the bottom wall of the case to attach the stand for support of the case in a deployed configuration.

In accordance with another embodiment of the present disclosure, a mobile workstation is provided that includes a case having an interior; a stenotype machine stored in the workstation and deployable partially out of the case through a first access opening in the case to an orientation that allows keys on the stenotype machine to be accessed for use and to be stored inside the case for transportation and storage; a personal computer with display screen stored in the workstation and accessible in a usable configuration through a second access opening in the case, the personal computer coupled electrically to the stenotype machine; a plurality of storage compartments in the case; and a handle and at least two wheels to facilitate movement of the case by hand.

In accordance with another aspect of the foregoing embodiment, the workstation includes first and second covers or access doors or panels for the first and second access openings, respectively, and further including a third access opening in the case to provide access to at least one of the plurality of storage compartments in the case and a third cover for the third access opening.

In accordance with a further aspect of the foregoing embodiment, the workstation includes a stand attachable to the case to support the case on a support surface when the stenotype machine is in use, the stand adapted to collapse and detach from the case for storage in one of the plurality of storage compartments that is accessible through the third access opening.

In accordance with another aspect of the present disclosure, a partition supporting the personal computer and dividing an interior of the case into a first area for storage and use of the personal computer and a second area for storage and use of the stenotype machine is provided. Ideally, the partition is hingedly attached to the case to enable pivoting of the partition and personal computer to uncover the second area in which the stenotype machine, and, ideally, the plurality of storage compartments are located

BRIEF DESCRIPTION OF THE SEVERAL VIEWS OF THE DRAWING(S)

The foregoing and other features and advantages of the present disclosure will be more readily appreciated as the same become better understood from the following detailed description when taken in conjunction with the accompanying drawings, wherein.

DETAILED DESCRIPTION OF THE INVENTION

Figure 1:
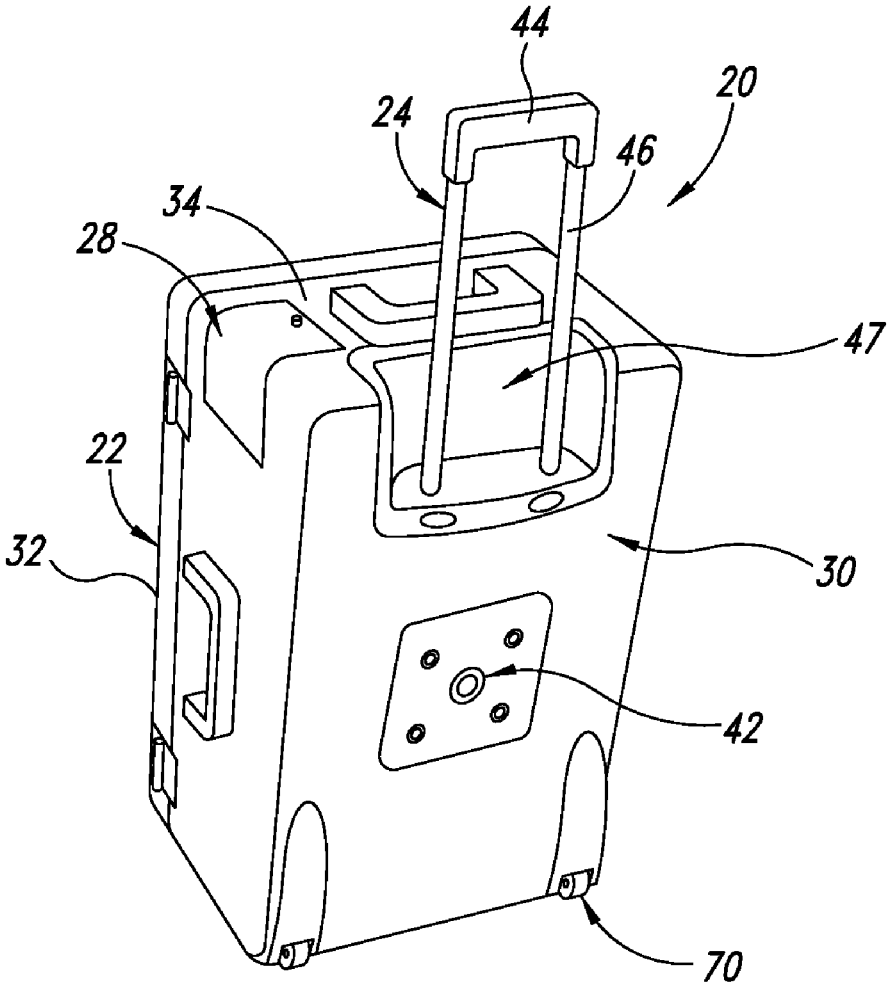
FIG. 1 is an isometric side view of a mobile workstation formed with the handle deployed in accordance with one embodiment of the present disclosure.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures or components or both associated with stenotype machines and portable computers, including but not limited to manual and electronic stenotype machines, laptop computers, and the like, have not been shown or described in order to avoid unnecessarily obscuring descriptions of the embodiments.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one embodiment" or "an embodiment" means that a particular feature, structure, or characteristic described in connection with the embodiment is included in at least one embodiment. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

It is to be understood that while the present embodiments are described in the context of court reporting equipment, the present disclosure will have application where portable equipment, particularly computer equipment, is to be transported, set up, and used on site, then disassembled, stored, and transported to a further site, such as an office, home office, maintenance facility or other location.

The court reporting industry utilizes stenotype machines having keys that a stenographer or machine shorthand reporter utilizes similar to a typewriter, except in a shorthand form, to record live or pre-recorded testimony, speeches, hearings, broadcasts, or other proceedings and events in which spoken words are to be recorded. Modern technology has the capability of translating the machine shorthand into written form for display on an electronic screen or printing onto paper. This electronic capability allows reporters to meet the increasing demand for transcripts in a timely manner.

Various providers and vendors offer the foregoing equipment to stenographers, reporters, videographers, and transcribers, on a commercially available basis, and these sources will not be described herein. Likewise, because the stenotype machines and computer-aided transcription and real-time reporting equipment is readily commercially available, it will not be described in detail herein.

Briefly, the stenotype machine 50 described herein has a number of keys that are pressed or "stroked" by the stenographer that create either a printed impression on paper, an electronic recording and display of the key pressed, or both. Multiple keys can be pressed at the same time to generate a paper or electronic display of letters and numbers, which represent spoken words as single words, phrases, or sentences, including punctuation. Having a display of what is written on the machine is important for a number of reasons, including on-site read back of prior testimony in court or other legal proceedings and verification of accuracy. Using computer-aided transcription, the machine strokes are interpreted, displayed on a screen, and stored in memory.

In the past, stenotype machines stood on a tri-pod stand with the keys in a horizontal orientation and facing the user. The user's hands must not be impeded by any existing structure in order to enter key strokes as fast as necessary to keep up with the speakers. In addition, quick and easy access to the paper, if used, or to the electronic display is important for prompt read back or verification of what was keyed into the machine. The case of the present disclosed embodiments is designed to meet these and other requirements as described more fully below.

Figure 2:
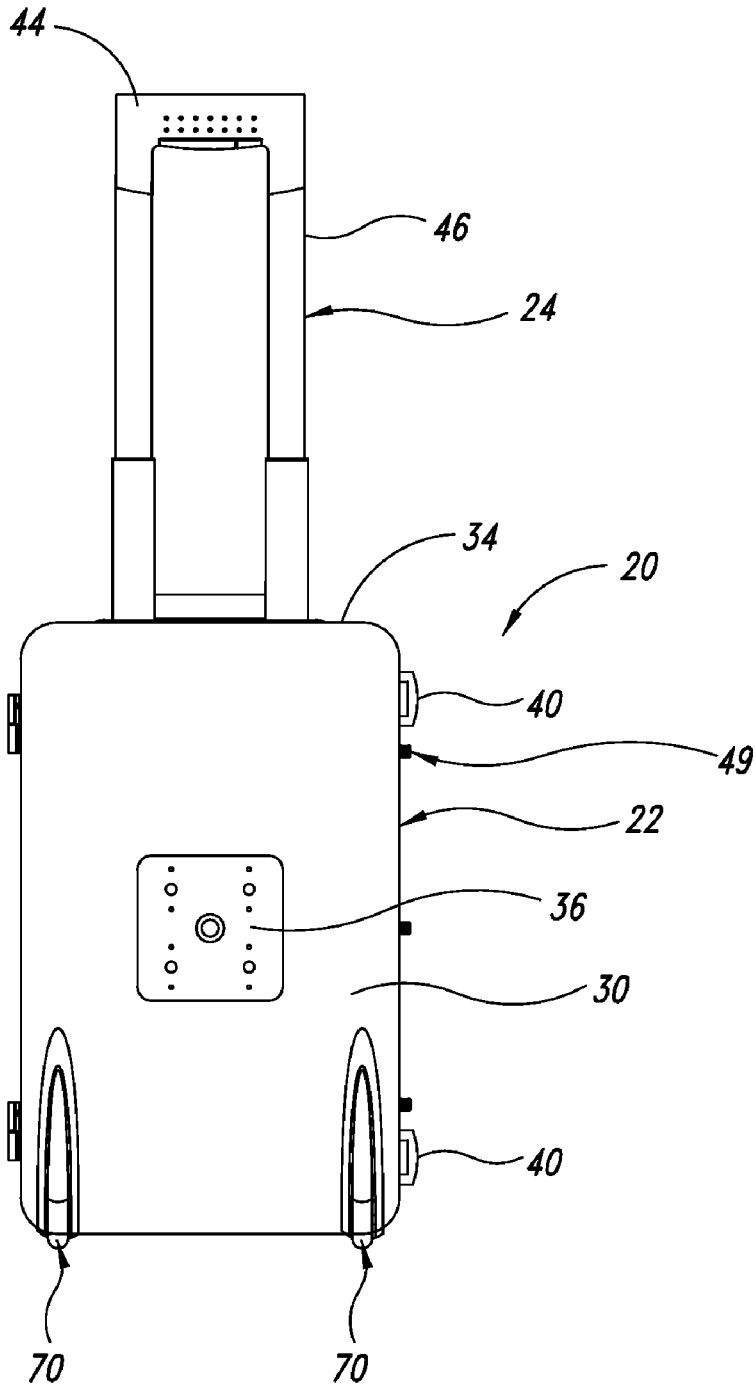
FIG. 2 is an isometric back view of the mobile workstation of FIG. 1 showing a bottom wall.
Figure 13:
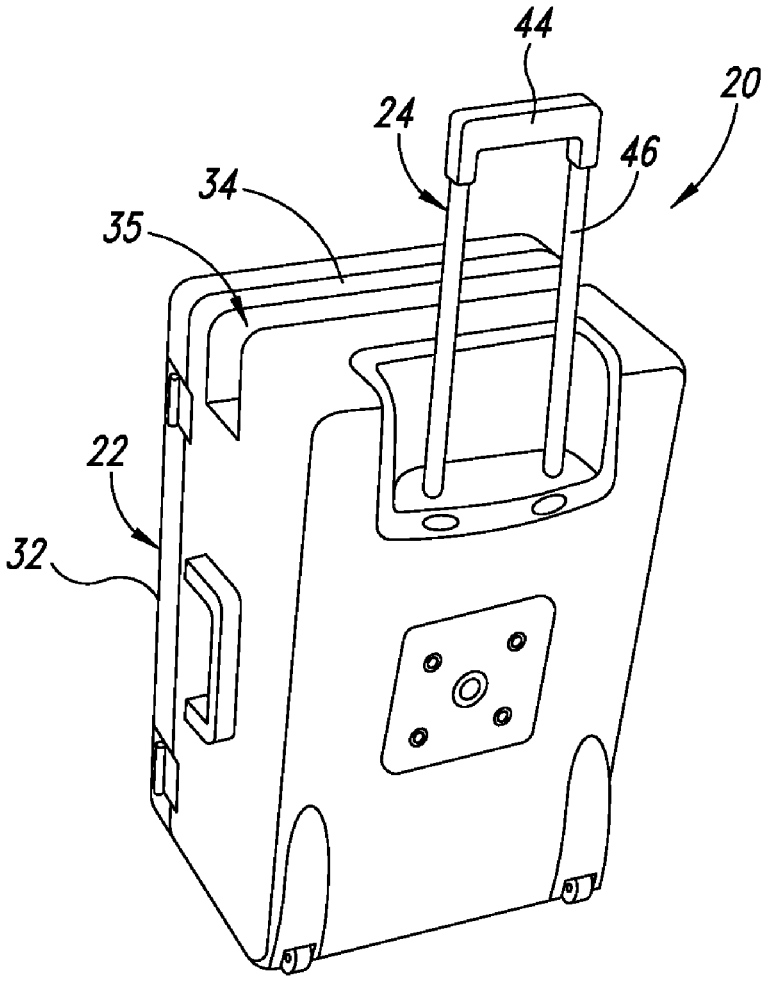
FIG. 13 is an isometric view of an alternative embodiment of the present disclosure.

Referring initially to FIGS. 1 and 2, shown therein is a mobile workstation 20 having a case 22 positioned in a vertical orientation with a handle 24 in an extended or deployed configuration. A tripod stand 26 (shown more clearly in FIG. 4) is stored in an interior compartment 76 (shown in FIG. 11) formed in the case 22 that is accessed through an access panel 28. It is to be understood that while the stand 26 is shown as a tripod configuration, a quadrapod or other known style of stand can be used. Also, while the stand 26 is shown stored in an interior compartment 80, the stand 26 can also be stored in an exterior channel 35 of the case 22 as shown in FIG. 13 and described more fully below. It should be further understood that the stand 26 is a readily commercially available unit and, hence, will not be described in detail herein.

In one configuration the case 22 can be used without a tripod. For example, the case 22 can be placed on a supporting table top or other flat surface in such a way that it will not slip or move when in use. Ideally such a supporting table top provides room for the user's legs, enabling the user to sit as close as necessary to access the system components for proper use. In this configuration, the case can include rubber feet or pads or other non-slip surface or structure to prevent the case from moving on the supporting table top or structure.

As shown in FIGS. 1-4, the case 22 is formed to include a bottom wall 30, top wall 32, and circumscribing sidewall 34 attached to the bottom wall 30. The bottom and side walls 30, 34 may be integrally formed or they may be formed as discrete components that are connected together using well-known techniques that will not be described herein. The top wall 32 is shown to be removably coupled to the circumscribing sidewall 34, and may be done so by conventional latches 40. Alternatively, in another embodiment the top wall 32 may be coupled to the sidewall 34 by one or more hinges on one side and the latches 40 on another side. In this particular embodiment, the top wall 32 is completely removable. The side wall 30 includes the access panel 28 that provides access to the tripod stand 26 (not shown) that is received in a corresponding threaded connection member 42 on the bottom wall 30.

The collapsible handle 24 includes a grip 44 attached to two extendible supports 46 that are slidably mounted to the bottom wall 30. The supports 46 slide into an interior space of the case 22. Because this style of handle is readily commercially available, its construction will not be described further. The handle 24 is stored in a recess 47 formed in the bottom wall 30 and side wall 34.

Figure 3:
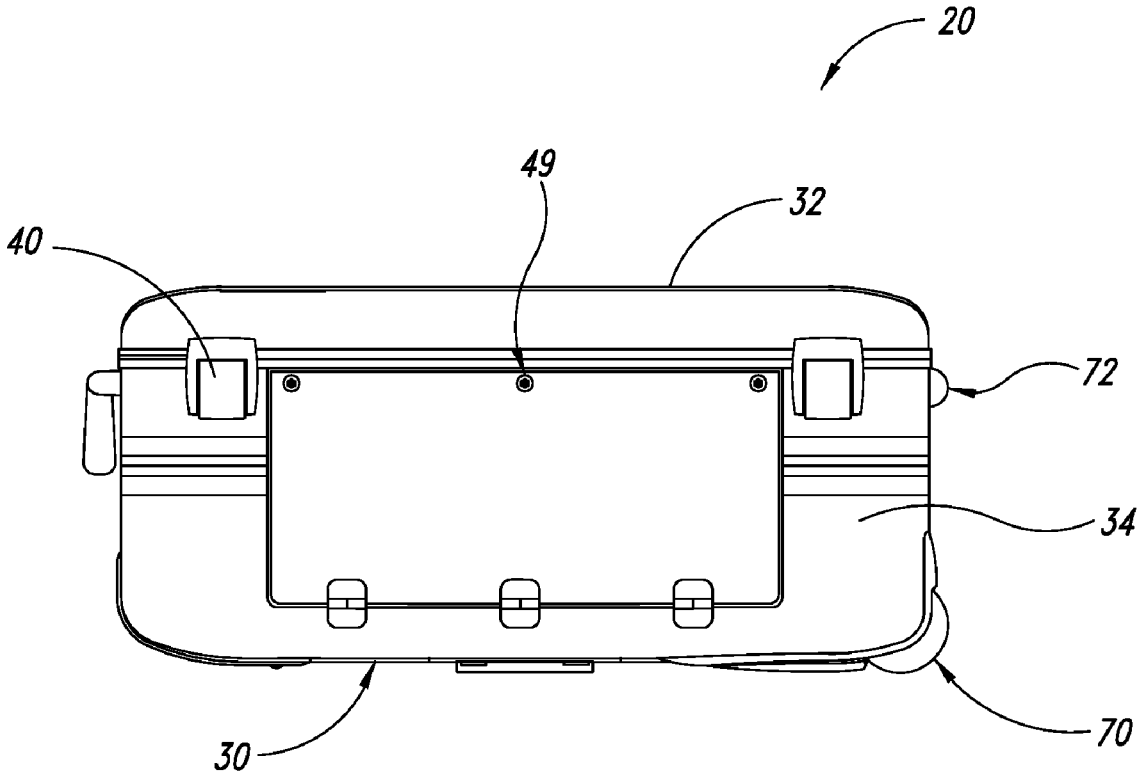
FIG. 3 is an isometric front view of the workstation in a horizontal position with the handle in a stored configuration and the bottom wall resting on a supporting surface.

Alternatively, a channel 35 can be formed in the circumscribing sidewall 34, as shown in the alternative embodiment of FIG. 13, so that when the workstation 20 is in the vertical orientation as shown in FIGS. 1, 2, 4, and 5, the channel 35 opens upward to receive the stand 26. Suitable securing means can be used to hold the stand 26 to the case 22. For example, when the case is placed in a horizontal position, as shown in FIG. 3, the case 22 is resting on the bottom wall 30, the stand 26 would be held in place in the channel.

Figure 4:
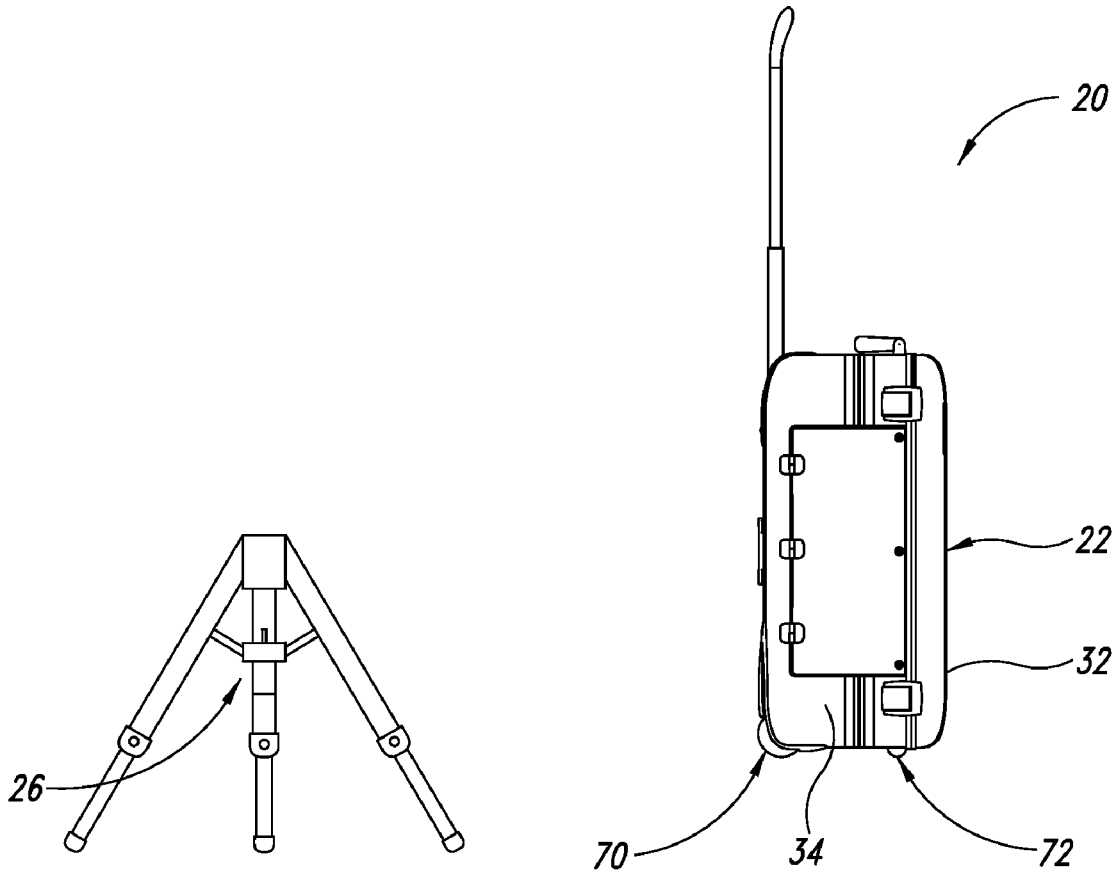
FIG. 4 is an isometric view of the workstation of FIG. 3 with the case in a vertical orientation, the handle deployed, and a stand in deployed condition located adjacent the case.
Figure 5:
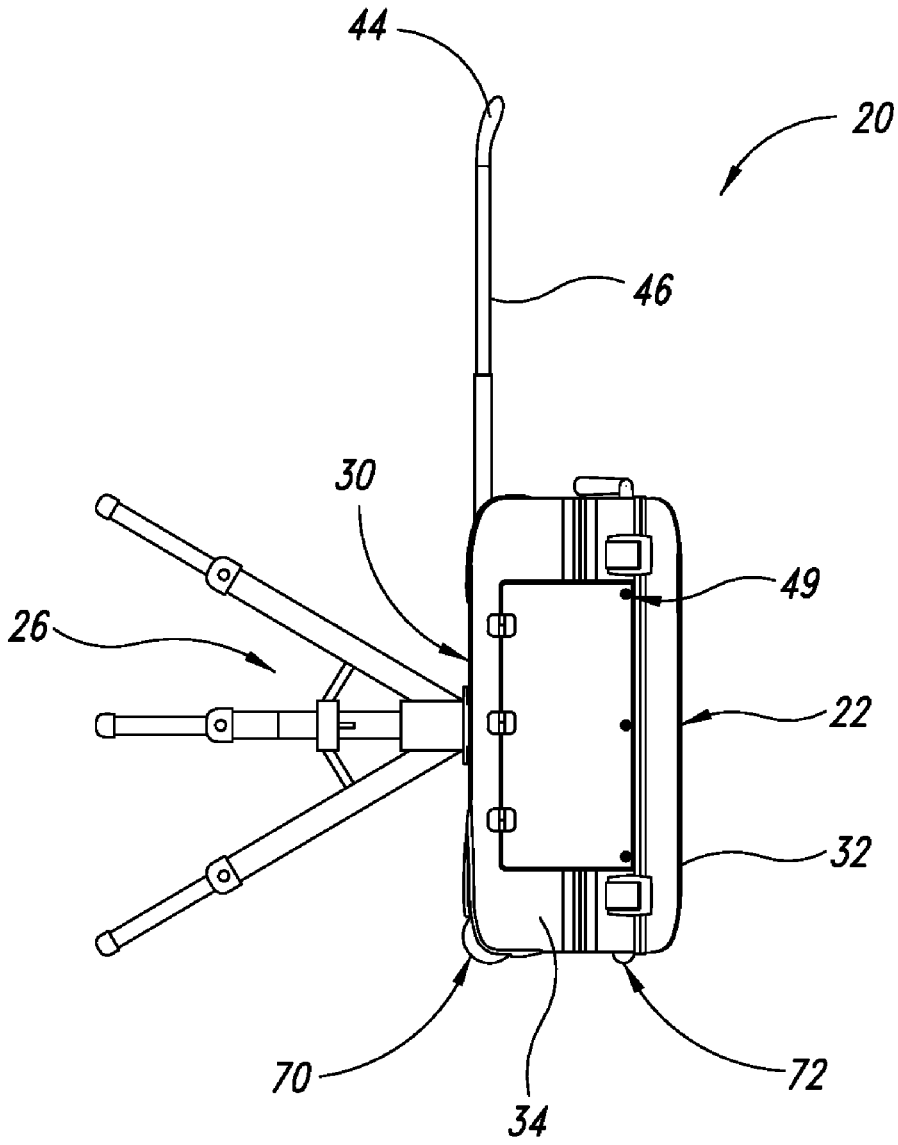
FIG. 5 is an isometric projection of the workstation of FIG. 4 with the stand attached to an attachment member in the bottom wall of the case.
Figure 6:
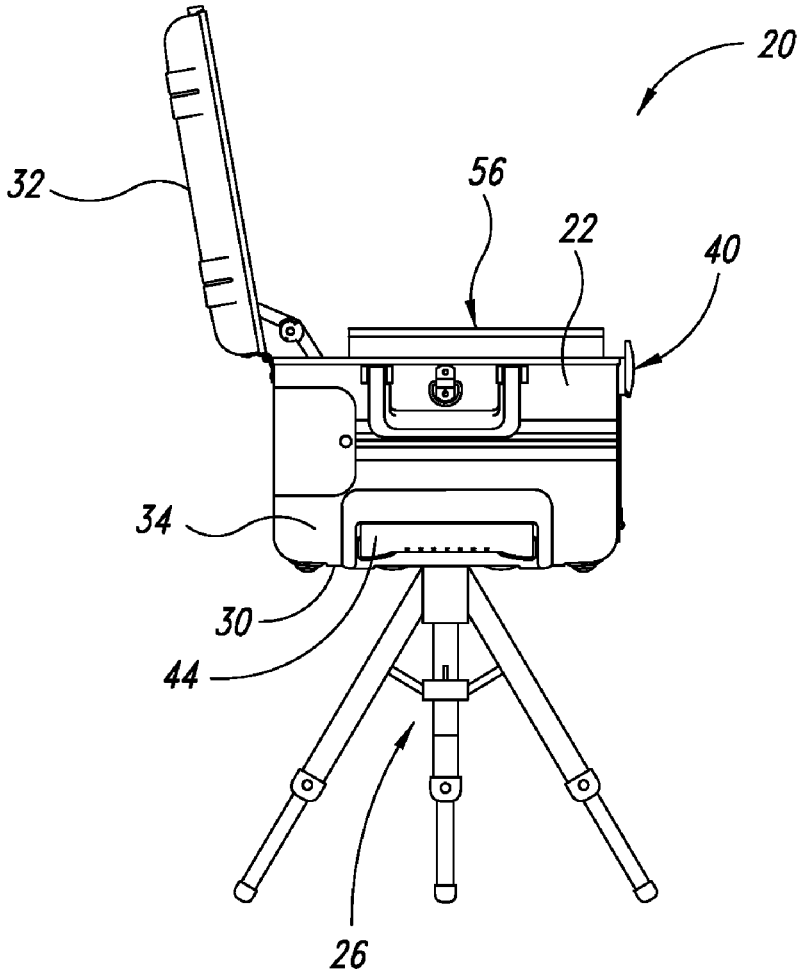
FIG. 6 is an isometric side view of the workstation of FIG. 5 with the stand supporting the case in an upright position, the handle stored, and the power cord extending from the sidewall in the front.

Returning to the first embodiment, in use, the workstation 20 is positioned in the vertical orientation, the stand 26 is removed through the access door 28, and the legs are deployed as shown in FIG. 4. The stand 26 is then attached to a conventional attachment member 42 associated with the bottom wall 30 while the case 22 is in the vertical orientation as shown in FIG. 5. Once the stand 26 is attached, the entire workstation 20 is then brought to a standing position and the handle 24 is pushed into the case 22, as shown in FIG. 6. The power cord 38 is extended out the front of the case 22.

It will be noted that the circumscribing sidewall 34 has on one side a pair of wheels 70 and short legs 72 ideally positioned near the corners of the sidewall 34 to support the workstation 20 in the vertical orientation. In addition, the wheels 70 allow the workstation to be pulled by the handle 24 so that the wheels 70 roll on the ground, sidewalk, floor, carpet, etc.

Figure 7:
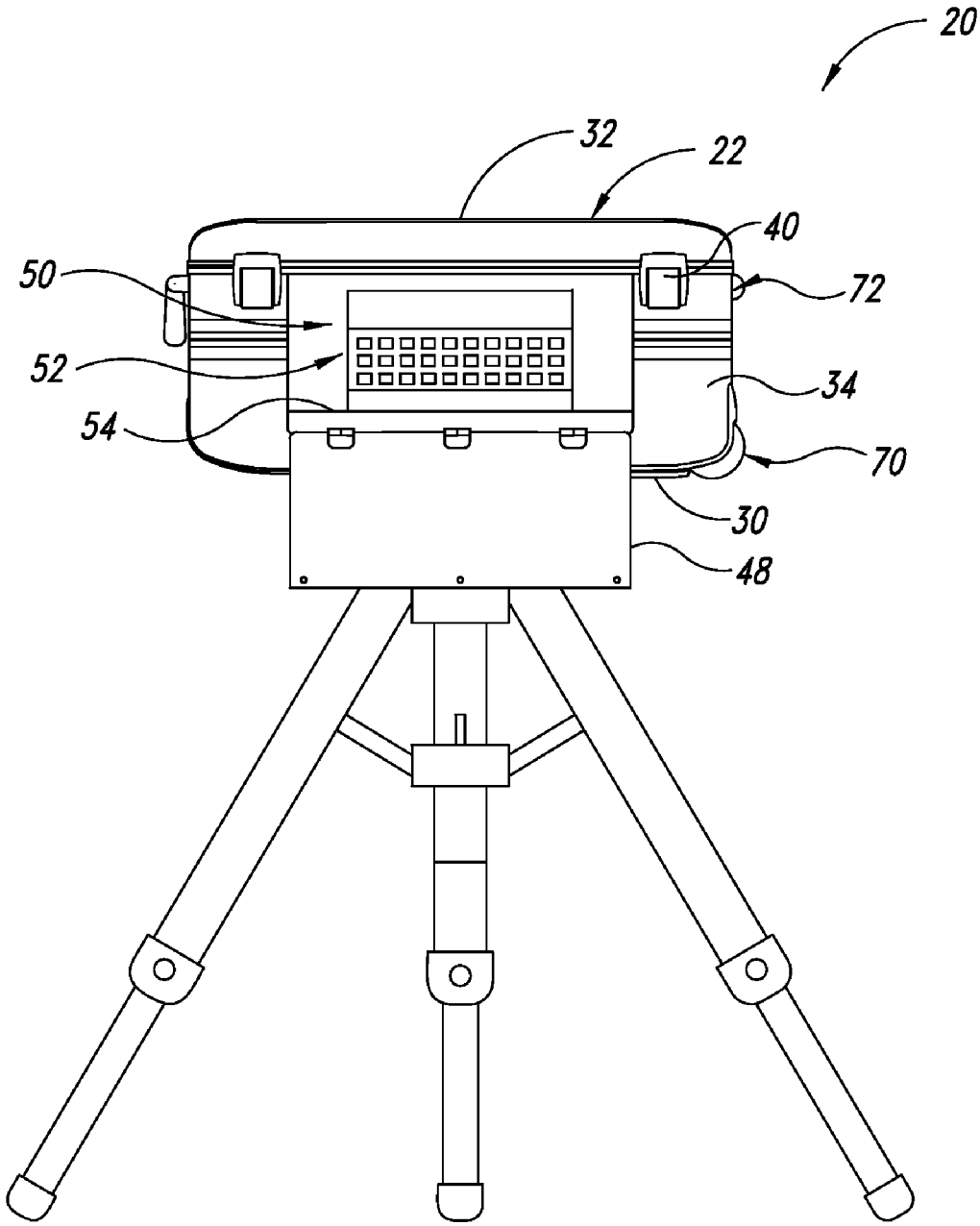
FIG. 7 is an isometric front view of the workstation of FIG. 6 with an access door in an open configuration revealing a stenotype machine stored in the case.

Referring next to the front views of FIGS. 7-10, these sequential illustrations show the steps to deploying the working equipment in the mobile workstation 20. More particularly, shown in FIG. 7 is an access door 48 hingedly attached to the sidewall 34 and pivoted downward to reveal a stenotype machine 50 stored in a first compartment 52 in the interior of the case 22. In this embodiment, latches 40 are first unlatched and the top wall 32 lifted slightly to release the access door 48. Alternatively, fasteners 49 can be used to secure the access door 48 to the case 22 in a closed position.

Figure 9:
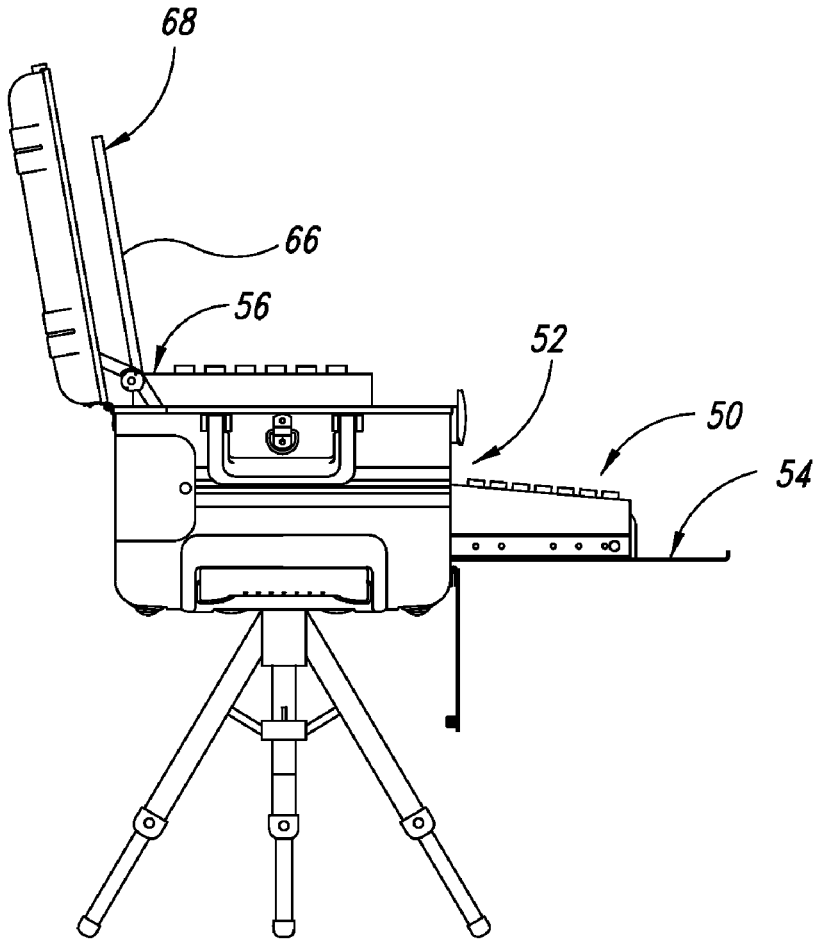
FIG. 9 is an isometric front view of the workstation of FIG. 8 with the stenotype machine and portable computer screen deployed for use.

The stenotype machine 50 is removably attached to a movable support 54 that can be pulled at least partially out of the first compartment 52 to place the court reporting machine 50 in a deployed and working condition, as shown in FIG. 9. The support 54 can be formed to roll or slide on tracks.

Figure 8:
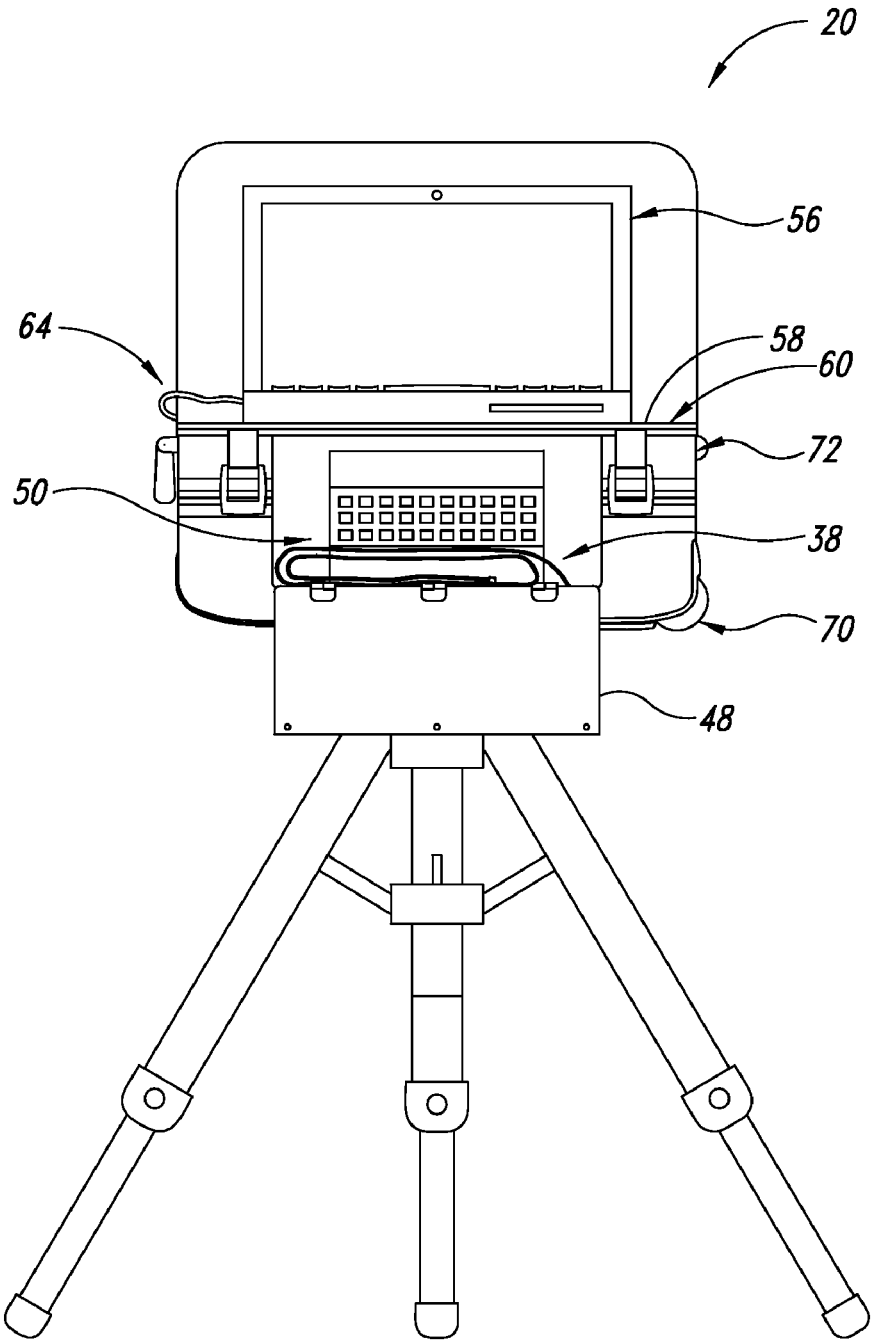
FIG. 8 is an isometric front view of the workstation of FIG. 7 with a top cover removed to reveal a portable computer.

Because most court reporters utilize machines that have computer-aided transcription, it is desirable to have a portable computer 56 stored in the case 22 and available for deployment and use. As shown in FIG. 8, the top wall or cover 32 is opened to reveal the portable computer 56 removably attached to a support surface 58 on an internal wall 60. An opening 62 in the internal wall 60 is sized and shaped to enable one or more cables 64 or power cords attached to the personal computer 56 to extend below the internal wall 60.

It will be noted that the power cord 38 is not attached to a wall outlet or other power source. This is because both the stenotype machine 50 and the portable computer 56 utilize their own power source, such as a rechargeable battery. However, to conserve power and to recharge the batteries, the cord 38 is plugged into an outlet or extension cord.

Velcro™ or other known fasteners are used to attach the portable computer 56 to the supporting surface 58. While it can be permanently attached, this is not desirable because of the need for the portable computer 56 to be used outside of the case 22. As shown in FIGS. 8-9, opening the top 68 of the portable computer 56 deploys or enables deployment of the computer screen 66 so that it is viewable when using the stenotype machine 50.

Figure 10:
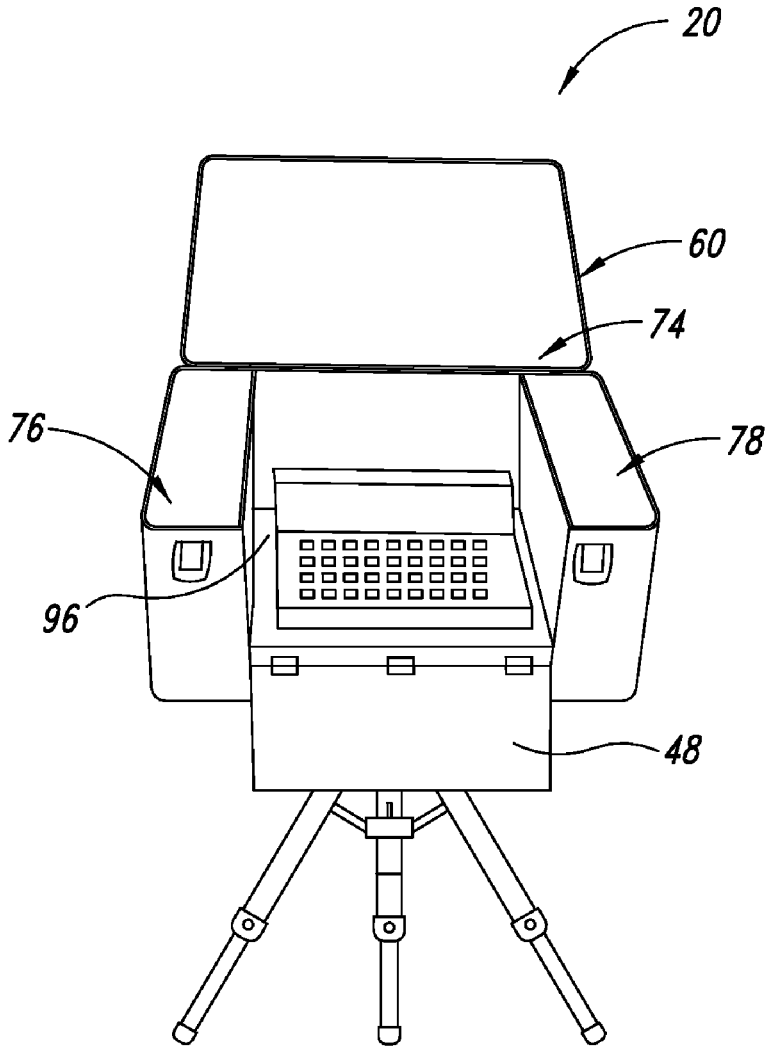
FIG. 10 is an isometric top view of an interior of the workstation case of FIG. 9 revealed by lifting the supporting surface for the portable computer.
Figure 11:
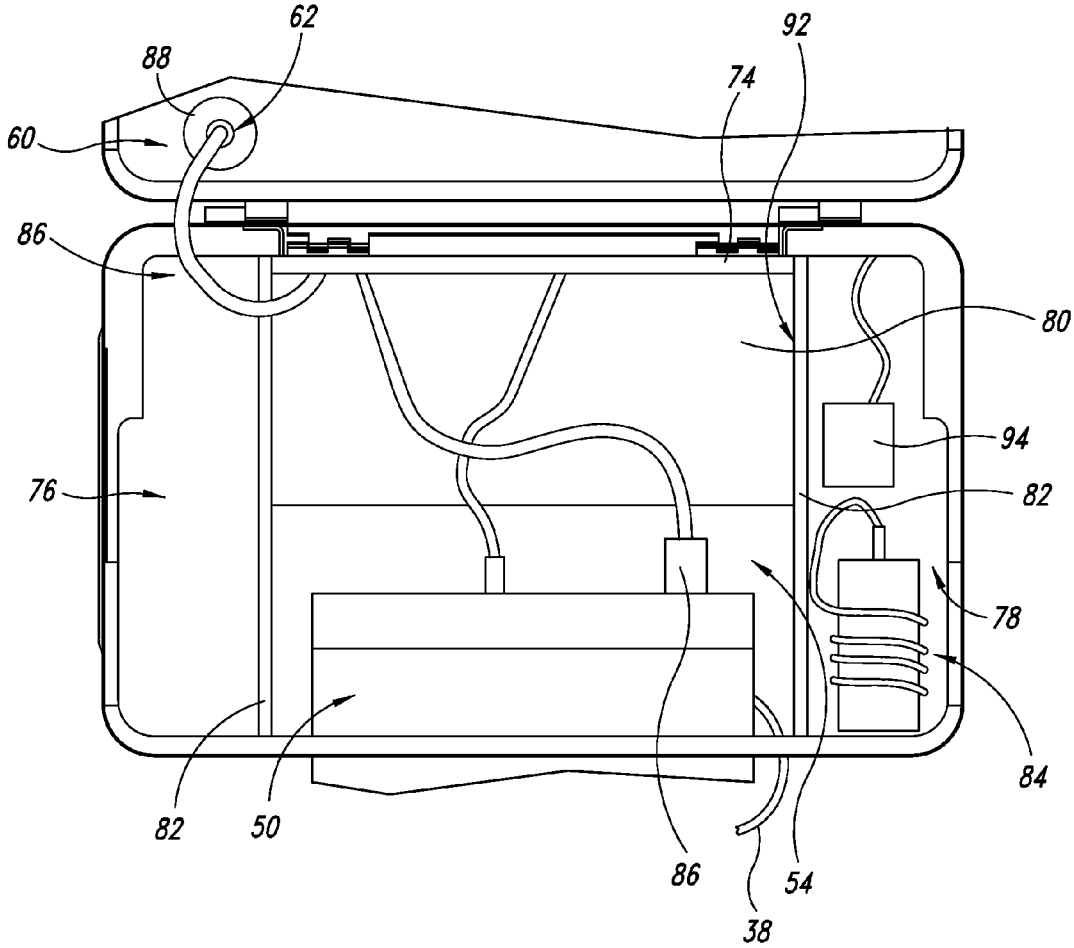
FIG. 11 is an isometric top view of interior compartments of the workstation case of FIG. 10.

Referring next to FIGS. 10 and 11, the interior of the case 22 is shown in greater detail wherein the internal wall 60, which functions as a tabletop for the portable computer 56, has now been pivoted about a connecting hinge 74. Ideally, the location of the stand 26 and the weight of the equipment are such that while the portable computer 56 remains attached to the supporting surface 58 of the internal wall 60 when it is in the open condition, the workstation 20 will not become unbalanced and tip over. The hinge 74 is configured to limit its movement so that the portable computer 56 does not contact the case 22, the top wall 32, or the circumscribing sidewall 34.

As revealed in FIGS. 10 and 11, beneath the internal wall 60 are three compartments, a first side compartment 76, a second side compartment 78, and a rear compartment 80. These compartments 76, 78, 80 are formed by internal partitions 82 that can be either permanently or integrally formed with the case 22 or removably attached to allow for custom configuration by a user.

As shown more clearly in FIG. 11, the first compartment 76 includes a portable battery 84 and a plurality of cables 86, that include power and data cables, some of which pass through a grommet 88 in the internal wall 60. In the rear compartment 80 is a power strip (not shown) attached to the power cord 38, which is shown extending through an opening 92 in the partition 82. A transformer 94 is attached to the power strip 90 to provide power to the stenotype machine 50. The second compartment 78 is used for user supplies, personal items, tools, etc.

Figure 12:
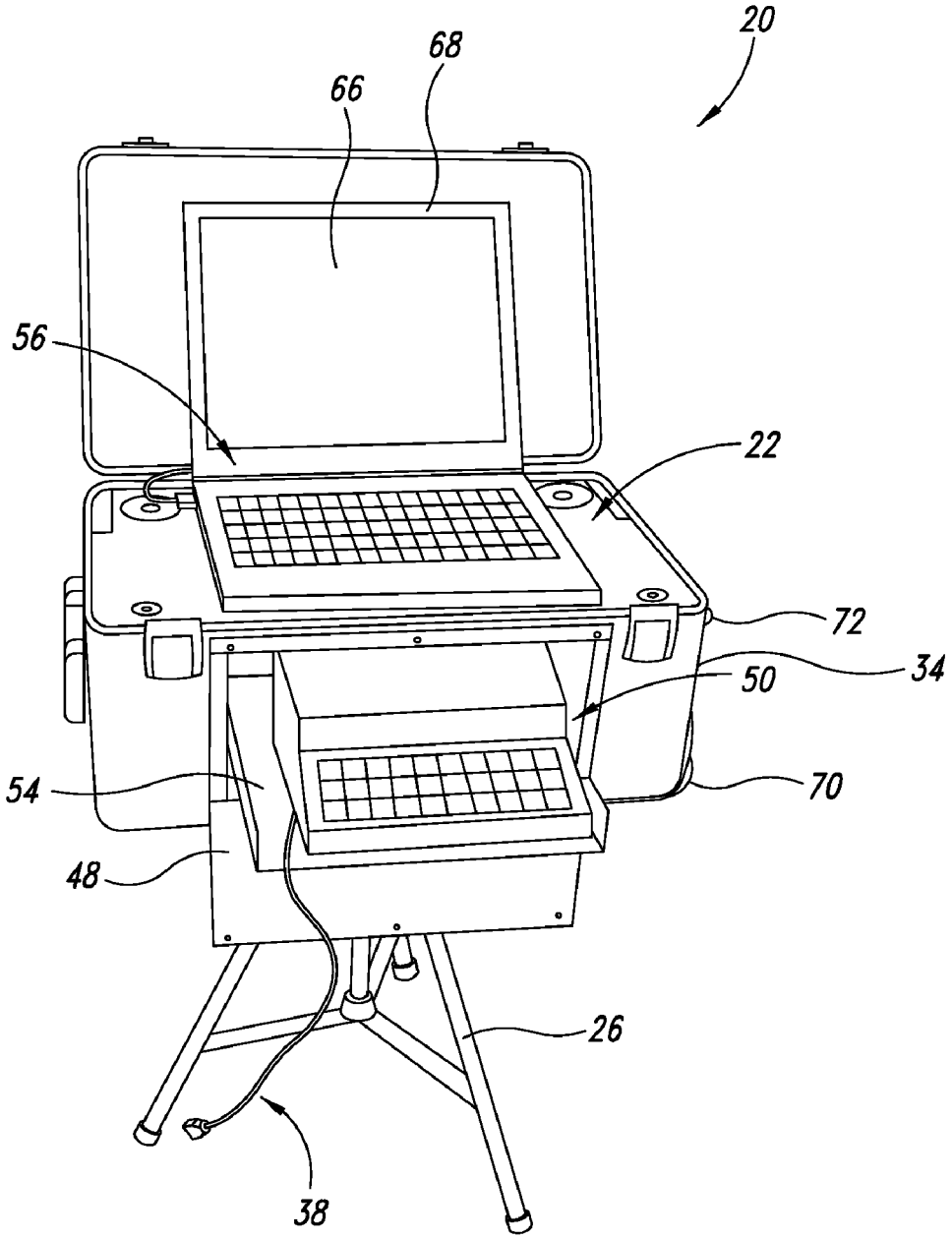
FIG. 12 is an isometric side view of the workstation of the present disclosure with the stenotype machine deployed and ready for use in conjunction with the portable computer.

Referring next to FIG. 12, as seen therein the mobile workstation 20 is in a fully deployed configuration with the stenotype machine 50 pulled partially out of the case 22 and angled downward for easy access to a user. Ideally, the movable support 54 for the stenotype machine 50 allows the machine to be angled downward at various settable positions. Thus, the movable support 54 can provide, for example, three angled settings as well as sliding or gliding into and out of the case 22, or it can be at a fixed setting.

Ideally, the case 22 and its associated components are formed of heat resistant aluminum, although ABS material can be used, which is light, easy to use in manufacturing, and durable as well as presenting an attractive appearance. Dimensionally, the case 22 can have dimensions of 21 inches by 13 inches by 9 inches in length, width, and depth, respectively. Ideally, the first side compartment 76 has a depth of 6 inches and the second side compartment 78 has a depth of 6 inches.

While the representative embodiment described herein is shown for use with a paperless stenotype machine 50, it is to be understood that the case 22 could be adapted to accommodate machines that utilize paper, although ease of use may lessen.

In use, the case 22 is transported to a conference room or a courtroom, where it is placed in the vertical position as shown in FIG. 1. The tripod stand 26 is taken out of the case 22 with the legs folded, screwed into the connection member 42 on the bottom wall 30, and the height positioned at a level desired by the user. The workstation 20 is then placed in an upright position as shown in FIG. 6. The latches 40 are released and the top wall or cover 32 is removed or rotated about hinges to provide access to the equipment. A safety Velcro over the portable computer 56 is removed, the top 68 is opened to reveal the screen 66, while the stenotype machine is extended out of the case 22, adjusted into its preferred declination on adjustable models, and the power cord 38 is pulled out and plugged into a wall outlet or other power source.

Because cords, cables, and security devices are already attached, the equipment is now ready for use. Estimated setup time, with some practice, is less than one minute. Ideally, users will always power down the computer when case 22 is closed, i.e., when the top wall 32 is attached to the sidewall 34. Because this case may be heavier than normal, users are cautioned to lift carefully.

While a preferred embodiment has been illustrated and described, it is to be understood that various changes can be made therein without departing from the spirit and scope of the disclosure. For example, a document holder can be attached to the case 22 that allows the user to view the document without interfering with viewing of the screen 66 on the portable computer 56.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A portable workstation, comprising:

a case having an interior;

a stenotype machine stored in the interior of the case and deployable partially out of the case through a first access opening in a side of the case to an orientation that allows keys on the stenotype machine to be accessed for use while supported by the case and to be returned back inside the case for transportation and storage;

a personal computer with display screen stored in the workstation and accessible in a usable configuration through a second access opening in a top of the case without interfering with use of the stenotype machine when the stenotype machine is deployed, the personal computer coupled electrically to the stenotype machine with data cables to display data from the stenotype machine;

a plurality of storage compartments in the case; and a handle and at least two wheels to facilitate movement of the case by hand.

2. The workstation of claim 1, comprising first and second covers for the first and second access openings, respectively, and further comprising a third access opening in the case to provide access to at least one of the plurality of storage compartments in the case and a third cover for the third access opening.

3. The workstation of claim 2, comprising a stand to support the case on a support surface when the stenotype machine is in use, the stand adapted to collapse for storage in one of the plurality of storage compartments that is accessible through the third access opening.

4. The workstation of claim 3, comprising a partition supporting the personal computer and dividing an interior of the case into a first area for storage and use of the personal computer and a second area for storage and use of the stenotype machine.

5. The workstation of claim 4, wherein the partition is hingedly attached to the case to enable pivoting of the partition and personal computer to uncover the second area in which the stenotype machine is located.

6. The workstation of claim 3, comprising a partition supporting the personal computer and dividing an interior of the case into a first area for storage and use of the personal computer and a second area for storage and use of the stenotype machine and for the plurality of storage compartments.

7. The workstation of claim 6, wherein the partition is hingedly attached to the case to enable pivoting of the partition and personal computer to uncover the second area in which the plurality of storage compartments and the stenotype machine are located.

* * * * *